United States Patent [19]

Webb et al.

[11] 4,074,166

[45] Feb. 14, 1978

[54] ULTRAVIOLET EMITTING ARC DISCHARGE LAMP

[75] Inventors: Edward A. Webb, Reading; Nikolaos Barakitis, Haverhill; Keith Pigott, West Peabody, all of Mass.

[73] Assignee: GTE Sylvania Incorporated, Danvers, Mass.

[21] Appl. No.: 743,265

[22] Filed: Nov. 19, 1976

[51] Int. Cl.[2] ..... H01J 61/12

[52] U.S. Cl. ..... 313/185; 313/174; 313/225; 313/229

[58] Field of Search ..... 313/185, 174, 225, 229

[56] References Cited

U.S. PATENT DOCUMENTS 4,000,431 12/1976 Brandli et al. ..... 313/185

*Primary Examiner*—Rudolph V. Rolinec
*Assistant Examiner*—Darwin R. Hostetter
*Attorney, Agent, or Firm*—James Theodosopoulos

[57] ABSTRACT

A highly loaded ultraviolet emitting arc discharge lamp has an arc length longer than 36 inches and contains a fill of mercury, inert gas at 8–10 torr and a small amount of niobium.

3 Claims, 1 Drawing Figure

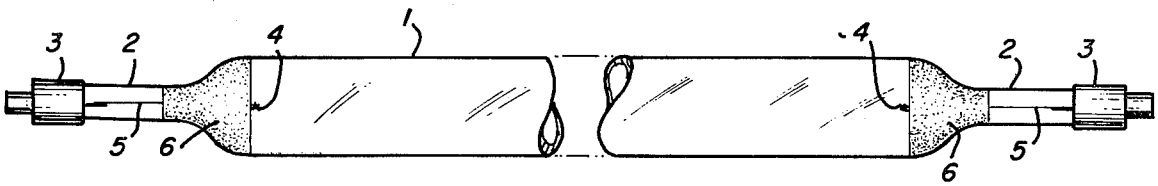
3
2
4
1
4
2
3
5
6
6
5

ULTRAVIOLET EMITTING ARC DISCHARGE LAMP

THE INVENTION

This invention relates to a medium pressure highly loaded arc discharge lamp, containing mercury and an inert gas, to be used as an efficient source of ultraviolet radiation. It is often observed that in such lamps having an arc length greater than 36 inches, instability of the arc occurs. This is often referred to as plasma oscillation. If the instability is not controlled, premature lamp failure will occur.

In the prior art, such instability was controlled by altering the electrical parameters of the lamp or ballast. The lamp voltage was decreased and the current increased, while maintaining the lamp wattage. The disadvantage of this method was that it necessitated a change in both the lamp and the ballast.

We have found that such instability can be prevented by close control of the pressure of the inert gas fill used in the lamp. In addition, a small amount of the refractory metal niobium is included in the fill to aid lamp stability.

We use a smaller amount of inert gas than has normally been used in the past, for example, 9 torr for a 200 watt per inch lamp as against the 16 torr previously used. The mercury content is increased slightly to give the desired arc voltage drop. This method of preventing arc instability does not affect the lamp physically, does not change any electrical parameters and does not necessitate changes in ballasting.

The single FIGURE in the drawing is a broken view of an arc discharge lamp in accordance with this invention.

The lamp comprises a cylindrical quartz arc tube 1 sealed at its ends 2 and having metal end contacts 3 electrically connected to internal electrodes 4 by means of lead-in wires 5 which are embedded in seals 2. A heat reflective material 6 is coated on the ends of arc tube 1 behind electrodes 4 to increase the temperature thereat during lamp operation.

In a prior art 42 inch lamp having a 22 mm I.D. quartz arc, the fill was 16 torr argon and 550 mg mercury and the lamp voltage was 1250 volts. When made in accordance with this invention, the fill was 9 torr argon, 680 mg mercury and 30 mg niobium and the lamp voltage was 1240 volts.

In a prior art 48 inch lamp, the fill was 16 torr argon and 750 mg mercury. When made in accordance with this invention, the fill was 9 torr argon, 900 mg mercury and 30 mg niobium.

For this invention, the inert gas pressure should be about 8–10 torr. Appreciably above this amount, arc instability occurs. Appreciably below this amount, a satisfactory arc discharge does not occur, only an undesirable high current glow diacharge.

It is not known why the presence of niobium in the arc tube aids in stabilizing the arc; it may be due to the ability of niobium to getter hydrogen.

We claim:

1. An ultraviolet-emitting highly loaded arc discharge lamp having an arc length greater than 36 inches containing an arc tube fill of mercury, inert gas and niobium, the inert gas pressure being between about 8–10 torr, the amount of niobium being adequate to stabilize the arc.

2. The lamp of claim 1 wherein the inert gas is argon.

3. The lamp of claim 2 wherein the argon pressure is 9 torr.

* * * * *